US007322891B1

(12) United States Patent
Prewitt

(10) Patent No.: US 7,322,891 B1
(45) Date of Patent: Jan. 29, 2008

(54) GOLF PUTTING TRAINING DEVICE

(76) Inventor: Terry Prewitt, 2031-106th Pl. SE., Everett, WA (US) 98208

( * ) Notice: Subject to any disclaimer, the term of this patent is extended or adjusted under 35 U.S.C. 154(b) by 0 days.

(21) Appl. No.: 11/543,594

(22) Filed: Oct. 5, 2006

(51) Int. Cl.
*A63B 69/36* (2006.01)

(52) U.S. Cl. ..... 473/236; 473/242; 473/252

(58) Field of Classification Search ..... 473/219, 473/223, 226, 236, 242, 244, 252; D21/736
See application file for complete search history.

(56) References Cited

U.S. PATENT DOCUMENTS

| | | | | |
|---|---|---|---|---|
| 3,021,141 | A | 2/1962 | Polsky et al. | |
| 3,039,776 | A * | 6/1962 | Faini | 473/236 |
| 3,194,564 | A | 7/1965 | Swan | |
| 4,002,343 | A | 1/1977 | Eckert | |
| 4,741,535 | A * | 5/1988 | Leonhardt | 473/252 |
| 4,846,477 | A | 7/1989 | Phelan | |
| 4,909,515 | A | 3/1990 | Redkey | |
| 5,011,153 | A | 4/1991 | Watkins | |
| 5,228,332 | A | 7/1993 | Bernhardt | |
| 5,351,961 | A * | 10/1994 | Eulau | 473/252 |
| 5,351,962 | A | 10/1994 | Lin | |
| 5,441,268 | A | 8/1995 | Shier | |
| 5,476,262 | A | 12/1995 | Bandiero | |
| 5,551,695 | A * | 9/1996 | Wolk | 473/236 |
| 5,810,675 | A | 9/1998 | Weathers | |
| 5,924,935 | A | 7/1999 | Prewitt | |
| 6,270,422 | B1 | 8/2001 | Fisher | |
| 6,379,259 | B1 | 4/2002 | Opie | |

* cited by examiner

*Primary Examiner*—Nini F. Legesse
(74) *Attorney, Agent, or Firm*—E. C. Spencer, Esq.

(57) ABSTRACT

A golf putting training device is provided which comprises a pair of alignment guides extending from the club face to provide a visual means of reference for the golfer during the putting stroke. The training device provides a means for the golfer to improve his accuracy through repeated use and allows muscle memory to remember the correct motion during the golf club swing.

16 Claims, 3 Drawing Sheets

GOLF PUTTING TRAINING DEVICE

BACKGROUND OF THE INVENTION

This invention relates to golf clubs and more specifically relates to a golf putting training device that provides a means for improving the putting accuracy of a golfer.

Conventional putting aides are typically comprised of complex structures that are designed to assist the golfer with their shot alignment. Many putting aides are comprised of complex mechanical structures that purportedly assist in the putter swing. Other putting aides have an aperture within the putter head behind the face of the putter head. Additional putting aides provide attachments to an existing putter head that form an aperture behind the putter head.

The main problem with conventional putting aides is that they are bulky and difficult to utilize. Another problem with conventional putting aides is that they do not effectively assist in the development of a controlled putting swing and are cumbersome to use. A further problem with conventional putting aides is that they sometimes significantly alter the balance and weight of the putter club and sometimes require the use of a putter device different from the user's preferred putter club. Still further, another problem with conventional putting aides is that they do not provide feedback from an actual golf ball.

Examples of patented devices which may be related to the present invention include U.S. Pat. No. 4,002,343 to Eckert; U.S. Pat. No. 5,476,262 to Bandiero; U.S. Pat. No. 5,351,962 to Lin; U.S. Pat. No. 6,379,259 to Opie; U.S. Pat. No. 4,909,515 to Redkey; U.S. Pat. No. 402,724 to Minami; U.S. Pat. No. 4,846,477 to Phelan; U.S. Pat. No. 5,441,268 to Shier; U.S. Pat. No. 5,228,332 to Bernhardt; and U.S. Pat. No. 6,270,422 to Fisher.

While these devices may be suitable for the particular purpose to which they address, there is still a need for a lightweight, inexpensive and easy to use putter training device. Prior art putting aides are complex and difficult to effectively utilize in the development of a controlled putting swing.

SUMMARY OF THE INVENTION

In one general aspect of the invention, a golf club swing training device is provided which comprises a golf club configured to strike a golf ball, and the golf club is comprised of a club head and a shaft. A spaced apart pair of alignment guides are provided that extend perpendicularly from a club face of the club head and the alignment guides are configured to provide a visual means of reference while during the swing of the golf club.

In another general aspect of the present invention a golf putter is provided comprising an elongated shaft having a first end and a second end. A grip is disposed on the first end and a club head is disposed on the second end. A pair of alignment guides are affixed to the club head, wherein the alignment guides are spaced apart and extend from the club head to provide a visual means of reference in relation to a golf ball.

In yet a further aspect of the present invention, a method for improving the accuracy of a golfer's putt is provided which comprises the steps of first providing a putter, the putter comprising a pair of spaced apart alignment guides that are configured to provide a visual means of reference in relation to a golf ball during the stroke of the putter. Next, the golfer strokes the putter repeatedly so as to strike a golf ball in an attempt to hit a fixed target with the golf ball, thereby training the golfer and improving accuracy.

These and other features, aspects and advantages of the invention will become better understood with reference to the following drawings, description, and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
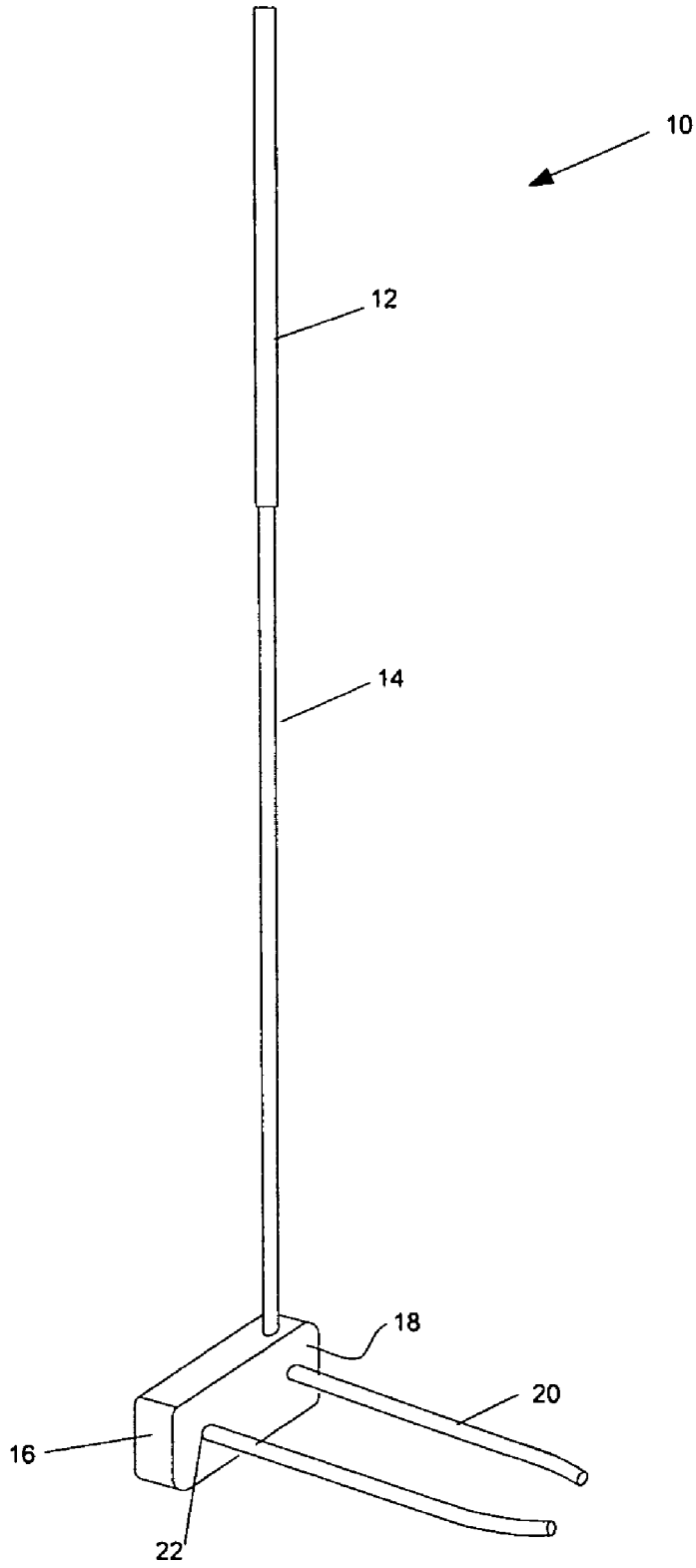
FIG. 1 is a simplified isometric view of a golf club in accordance with the invention.

Referring first to FIG. 1, which shows generally a isometric view of a golf putting training device 10 in accordance with the invention. An elongated shaft 14 extends from a grip portion 12 to a club head 16. A pair of generally parallel alignment guides 20 extend substantially perpendicularly from a club face 18. The alignment guides 20 are configured to extend substantially parallel to the ground and at right angles to club face 18 so as to provide a visual means of reference for the golfer during the swing of the club.

Figure 2:
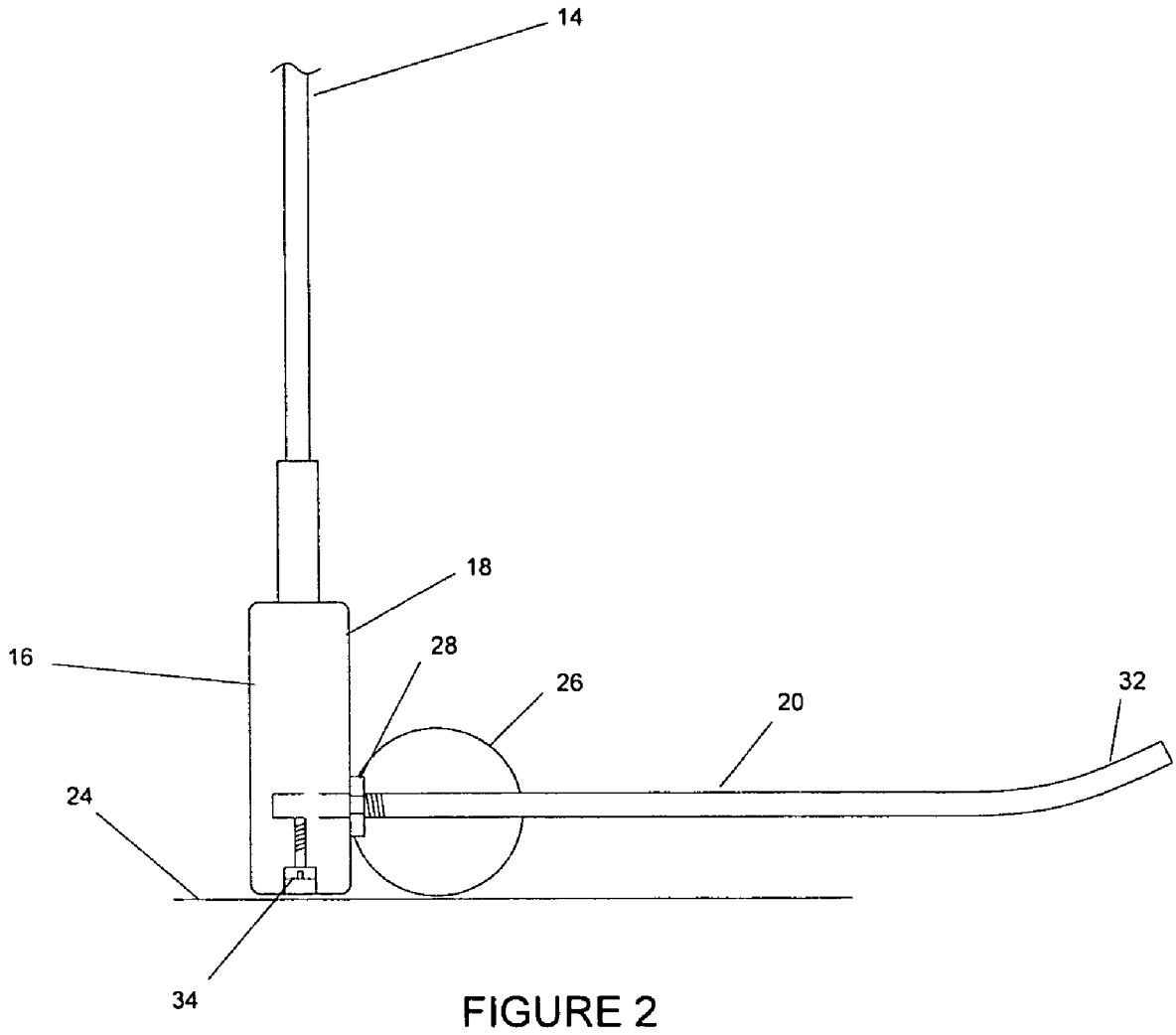
FIG. 2 is a close up, cross-sectional view of the club head in accordance with the invention.
Figure 3:
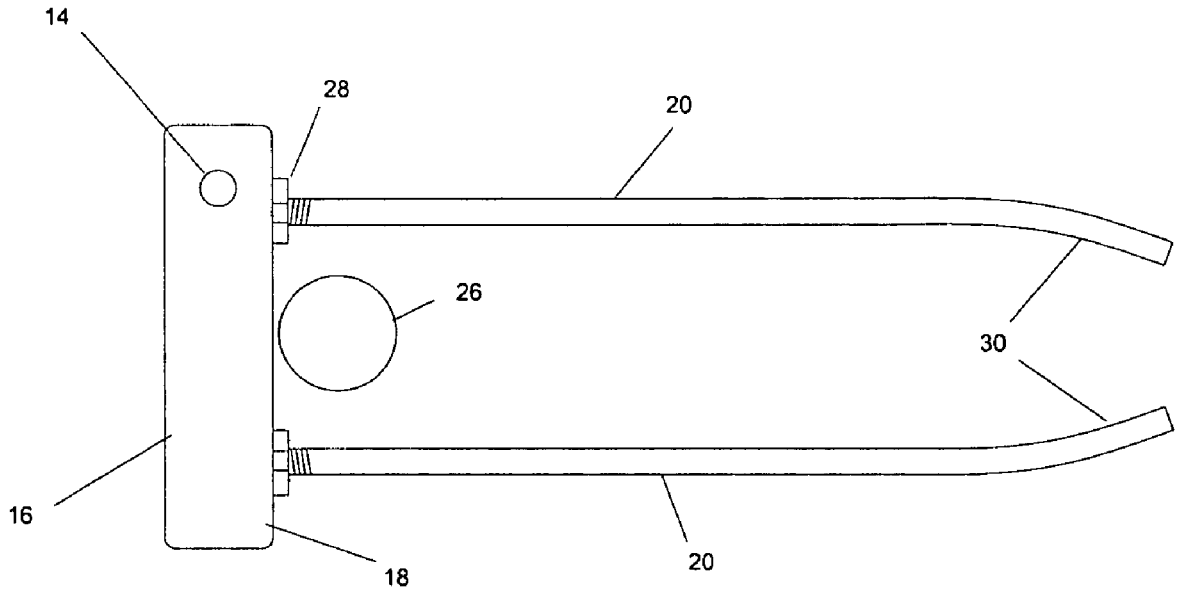
FIG. 3 is a simplified top view of the club head in accordance with the invention.

Referring now to FIGS. 2 and 3, where like features have like numerals, a golf ball 26 is placed on the ground 24 between the pair of alignment guides 20. The alignment guides 20 may be threadably inserted into the club face 18 and a lock nut 28 may be provided on each respective alignment guide 20 to secure the alignment and placement of the alignment guides 20 to the club face 18. Alternatively, the alignment guides may be permanently affixed to the club face 18 using all known means for such attachment. Still further, the alignment guides 20 may be removably disposed on the club head 16 so as to eliminate the need for the golfer to purchase a separate putter.

The alignment guides 20 may be comprised of a cylindrical rod and have a predetermined upward curvature 32 to allow for the arcing swing of the golf club. Further, the alignment guides may also have a predetermined inward curvature 30 such that the gap between the golf ball 26 and the respective alignment guides 20 decreases as the back stroke away from the golf ball 26 increases. The alignment guides 20 are adjustable such that the space between the alignment guides 20 can be altered. Depending on the skill level of the user, the alignment guides 20 may be rotated such that the gap between the alignment guides 20 can be increased or decreased by rotating each alignment guide 20. To perform this adjustment, the user may loosen the lock nut 28 so that the alignment guide 20 may be rotated such that the curvature 32 acts to increase or decrease the gap between the alignment guides 20. Increasing the gap would allow a lower skilled user to use the training device and decreasing the gap would allow a more advanced user to hone their putting skill by decreasing the space for the golf ball to travel in both the back stroke and the follow through.

The golf putting training device 10 trains the user by aiding the user in implementing a correct swing in which the alignment guides 20 remain at an equal distance from the ball 26 throughout the swing, thereby maintaining the club face at a perpendicular orientation to the direction of the swing for proper contact with the ball. Practice or repetition of the swing with the training device 10 allows muscle memory to "remember" the correct motion when the golf swing is performed without the training device.

It should be understood, of course, that the foregoing relates to preferred embodiments of the invention and that modifications may be made without departing from the spirit and scope of the invention as set forth in the following claims.

What is claimed is:

1. A golf club swing training device comprising, a golf club configured to strike a golf ball, said golf club comprising a grip, a club head and a shaft;

a pair of adjustable alignment guides, said alignment guides being spaced apart and extending substantially perpendicularly in the direction of the golf ball travel from a club face of said club head, said alignment guides configured to provide a visual means of reference while said golf club is swung;

wherein said pair of adjustable alignment guides are curved upwardly to allow for the extended back swing of said club head without said alignment guides striking the ground and said alignment guides are also selectively adjustable curved inwardly toward the golf ball to provide a more precise means of alignment during an extended back swing of said club head.

2. The golf club swing training device of claim 1, wherein said golf club comprises a putter.

3. The golf club swing training device of claim 1, wherein said adjustable alignment guides are permanently affixed to said club face.

4. The golf club swing training device of claim 3, wherein each said adjustable alignment guide comprises an externally threaded surface that is threaded into a respective threaded hole in said club face.

5. The golf club swing training device of claim 4, further comprising a pair of locknuts, each locknut configured to further retain each said alignment guide to said club face.

6. The golf club swing training device of claim 1, wherein the shape and path of said adjustable alignment guides is configured to allow for the extended arcing back swing of said golf club.

7. The golf club swing training device of claim 6, wherein said adjustable alignment guides are also bent inwardly along their respective longitudinal axis to decrease the distance between the golf ball and said respective alignment guide during the back swing of said club.

8. The golf club swing training device of claim 1, wherein said alignment guides are removably disposed on said club head.

9. A golf putter comprising;

an elongated shaft having a first end and a second end;

a grip disposed on said first end;

a club head disposed on said second end;

a pair of adjustable alignment guides affixed to said club head, said alignment guides being spaced apart and extending in the direction of ball travel from said club head, said adjustable alignment guides configured to provide a visual means of reference in relation to a golf ball;

wherein said pair of adjustable alignment guides are curved upwardly to allow for the extended back swing of said club head without said alignment guides striking the ground and said alignment guides are also selectively adjustable curved inwardly toward the golf ball to provide a more precise means of alignment during the extended back swing of said club head.

10. The golf putter of claim 9, wherein said alignment guides are permanently affixed to said club head.

11. The golf putter of claim 10, wherein said alignment guides comprise an externally threaded surface that is threaded into a respective threaded hole in said club head.

12. The golf putter of claim 11, further comprising a pair of locknuts disposed on a respective said alignment guide, each locknut configured to further retain each said alignment guide to said club head.

13. The golf putter of claim 9, wherein said alignment guides are adjustable to increase or decrease the gap between said alignment guides.

14. The golf putter of claim 13, wherein said alignment guides are also bent inwardly along their respective longitudinal axis to decrease the distance between a golf ball and a respective said alignment guide which thereby provides a more precise means of reference during an extended back swing of said club.

15. The golf putter of claim 9, wherein said alignment guides are removably disposed on said club head.

16. A method for improving the accuracy of a golfer's putt, comprising the steps of;

providing a putter, said putter further comprising a pair of spaced apart alignment guides, said alignment guides configured to curve upwardly and inwardly to provide a more precise visual means of reference in relation to a golf ball during the extended back stroke of said putter; and stroking said putter repeatedly so as to strike a golf ball in an attempt to hit a fixed target with the golf ball, thereby training the golfer and improving accuracy.

* * * * *